US006843154B2

(12) United States Patent
Webster et al.

(10) Patent No.: US 6,843,154 B2
(45) Date of Patent: Jan. 18, 2005

(54) DRUM PLUG AND FAUCET WRENCH

(75) Inventors: Deryl T. Webster, Angola, IN (US); Andy Link, Hamilton, IN (US); Ralph Trine, Angola, IN (US); Kenneth Schneider, Auburn, IN (US); Matthew Clemens, Angola, IN (US)

(73) Assignee: Vestil Manufacturing Company, Angola, IN (US)

( * ) Notice: Subject to any disclaimer, the term of this patent is extended or adjusted under 35 U.S.C. 154(b) by 25 days.

(21) Appl. No.: 10/083,986

(22) Filed: Feb. 27, 2002

(65) Prior Publication Data

US 2003/0159547 A1 Aug. 28, 2003

(51) Int. Cl.[7] ..... B25B 13/00
(52) U.S. Cl. ..... 81/125.1; 81/176.1; 81/177.1
(58) Field of Search ..... 81/125.1, 176.1, 81/176.15, 3.09, 177.1; 7/138, 151

(56) References Cited

U.S. PATENT DOCUMENTS

| | | | | | |
|---|---|---|---|---|---|
| 135,084 | A | * | 1/1873 | Cooper | 81/125.1 |
| 1,222,780 | A | * | 4/1917 | McElroy | 24/40 |
| 1,226,228 | A | * | 5/1917 | McKinzie | 81/125.1 |
| D142,263 | S | * | 8/1945 | Pierre | D8/26 |
| 2,421,665 | A | | 6/1947 | Umbdenstock | |
| 2,576,193 | A | | 11/1951 | Reynolds | |
| 2,643,566 | A | | 6/1953 | Dos Santos et al. | |
| 2,696,317 | A | | 12/1954 | Toffolon | |
| 2,705,433 | A | * | 4/1955 | Goldman | 81/125.1 |
| 2,831,720 | A | | 4/1958 | Renfroe | |
| 3,352,591 | A | | 11/1967 | Casey | |
| 3,488,079 | A | | 1/1970 | Stinchfield | |
| 3,733,938 | A | | 5/1973 | Smith | |
| 3,915,488 | A | | 10/1975 | Anderson | |
| 4,009,898 | A | | 3/1977 | Hampton | |
| 4,073,175 | A | | 2/1978 | Seamon | |
| 4,359,241 | A | | 11/1982 | Kistner | |
| 4,832,391 | A | | 5/1989 | Moell | |
| 4,911,605 | A | | 3/1990 | Berg | |
| 5,134,905 | A | | 8/1992 | Brennan et al. | |
| 5,171,053 | A | | 12/1992 | Rouleau | |
| 5,224,746 | A | | 7/1993 | Mullins | |
| 5,303,968 | A | | 4/1994 | Trine | |
| 5,425,289 | A | | 6/1995 | Iwinski | |
| 5,501,497 | A | | 3/1996 | Holloway | |
| 5,618,154 | A | | 4/1997 | Irons, Jr. et al. | |
| 5,819,610 | A | * | 10/1998 | Brannan | 81/437 |
| 6,048,009 | A | | 4/2000 | Sorg | |

OTHER PUBLICATIONS

Leverage Opener, item 1260, BASCO advertisement, p. 1.*

* cited by examiner

*Primary Examiner*—David B. Thomas
(74) *Attorney, Agent, or Firm*—Baker & Daniels

(57) ABSTRACT

A drum plug and faucet wrench includes an elongated body having first and second opposite ends, with each end having at least one drum plug drive element. Preferably at least three drive elements are included. Each plug drive element is configured differently from the other drive elements so that the tool can be used on a variety of plug types. The body has at least one flange projecting therefrom with at least two open end wrench heads formed in the flange. Each open end wrench head is of a different size from the other. One open end wrench head can be sized for use with drum faucets while the other can be sized for use with drum ring bolts.

10 Claims, 3 Drawing Sheets

DRUM PLUG AND FAUCET WRENCH

FIELD OF THE INVENTION

This invention relates generally to drum working tools, and particularly to a combination drum and faucet wrench for use on steel, fiber or plastic drums.

BACKGROUND OF THE INVENTION

Storage drums or barrels are commonly used for storing and transporting various commodities in both liquid and dry form. Such drums are typically cylindrical in shape and made of steel, fiber, or plastic.

Drums carrying liquid materials usually feature a top lid having one or more pour and vent holes which are closed using a variety of seals and plugs of different types and sizes for transport and storage. The plugs are placed in a pour hole located in the drum with a seal located over the plug to prevent leakage of the material from the drum. Other products are shipped and stored in drums having removable lids that are installed and sealed with a drum ring.

In order to remove such seals and plugs, one of several wrenches designed particularly for removing drum seals and plugs is required. Because it is time-consuming for a worker to have to switch from one tool to another, wrenches have been developed with multiple sized heads providing some degree of versatility so that a different wrench is not required for each and every type of plug or seal. Several wrenches are shown in the prior art, for example, see U.S. Pat. Nos. 2,421,665; 2,643,566; 3,733,938; 5,134,905; and 5,425,289 all incorporated herein by reference.

Overlooked however, has been the fact that there are additional requirements involving the removal and installation of drum rings and faucets of varying sizes. Accordingly, a need exists for a tool that can be used for manipulating various drum plugs and also for the various ring bolts and faucets.

SUMMARY OF THE INVENTION

The present invention provides a combination drum plug and faucet wrench that includes an elongated body having at least one plug drive element at each end. The body further includes multiple open end wrench heads for manipulating drum faucets and drum ring bolts. The open end wrench heads are formed in at least one flange projecting from the body.

In one embodiment, the body of the wrench is bent at an angle of about 140 degrees and each end has a plug tool head. Each plug tool head has two plug drive elements. Each of the drive elements is different from the others so that the wrench can be used on at least four different plug types. The body of the wrench has a flange that includes two open end wrench heads of differing sizes, one for ring bolts and one for faucets.

In another embodiment, the body has a plug tool head at one end that has two different plug drive elements. The other end has a single drive element attached at an angle to the body. The body has two flanges on opposite sides of the body adjacent the tool head. Each flange has an open end wrench head that differs in size from the other. Accordingly, the invention accomplishes a primary objective of providing a single tool that can be used for manipulating a variety of drum plugs as well as drum faucets and ring bolts.

DESCRIPTION OF THE PREFERRED EMBODIMENTS

Figure 1:
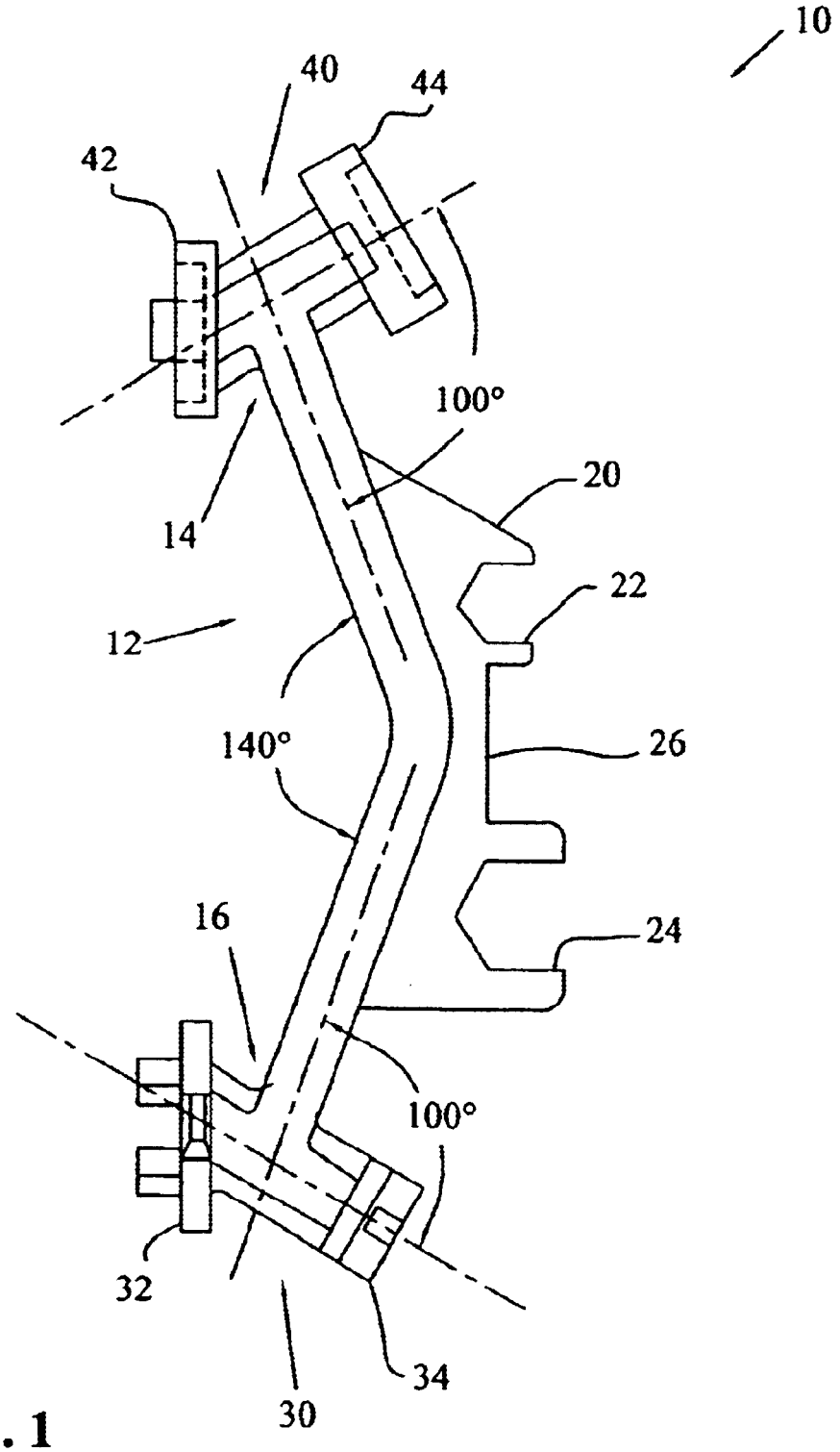
FIG. 1 is a side elevational view of one embodiment of a drum and faucet wrench according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Referring to FIG. 1, one embodiment of a combination drum plug and faucet wrench according to the present invention is generally indicated at the numeral 10. In the embodiment of FIG. 1, the wrench 10 includes an elongated body 12 having ends 14 and 16. A plug tool head 40 is attached at end 14. The tool head 40 includes a pair of drum plug drive elements 42 and 44 at opposite ends of the plug tool head 40. Drive elements 42 and 44 are shown in detail in FIGS. 2 and 3, respectively.

A second plug tool head 30 is attached to the body 12 at its other end 16. Plug tool head 30 also includes a pair of drive elements 32 and 34 at its ends. Drive elements 32 and 34 are shown in detail in FIGS. 4 and 5, respectively.

Figure 2:
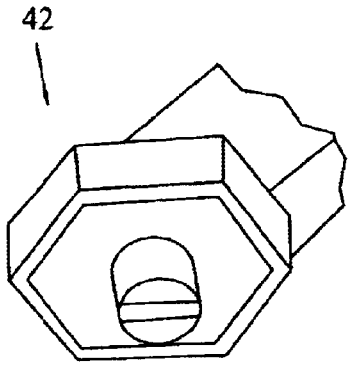
FIGS. 2–5 are perspective views of the drum plug drive elements of the wrench of FIG. 1.
Figure 3:
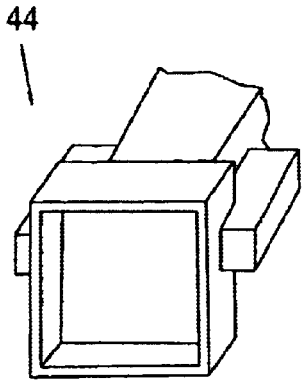
Figure 4:
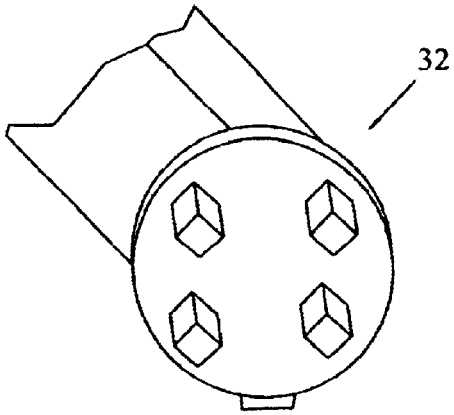
Figure 5:
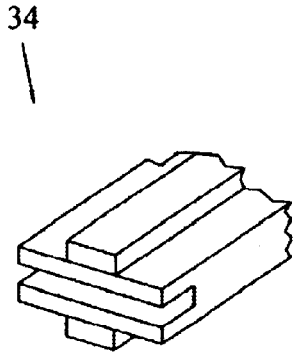

As shown in FIGS. 2–4, drive elements 32, 34, 42, and 44 are configured differently from each other so that at least four different types of drum plugs/nuts can be manipulated with a single wrench. Plug tool heads 30 and 40 are fixedly attached to body ends 16 and 14, respectively, at an angle of approximately 100 degrees with their respective ends. Alternatively, plug tool heads 30 and 40 may be integrally formed with the body 12.

Referring still to FIG. 1, the body 12 can exhibit a bend approximately equidistant from ends 14 and 16. It should be noted that when the body 12 is bent, the bend in the body 12 and the angle of attachment of the tool heads 30 and 40 to ends 16 and 14, respectively, occur in a single plane. When the body 12 is bent, the bend is preferably at an angle of about 140 degrees.

With reference still to FIG. 1, flange 20 is shown projecting from the body 12 in the plane of the bend in the body 12. In the flange 20, there is formed a pair of open end wrench heads 22 and 24 which can be sized for manipulating ring bolts and faucets. For instance, wrench head 22 can be sized at about 15/16 inches which is a common ring bolt size, while wrench head 24 can be sized at about 1¼ inches which is a common size for faucet fittings. Other sizes, however, may also be employed. The squared section 26 on flange 20 can be used as an additional wrench head for square nuts or drum plugs/nuts.

Figure 6:
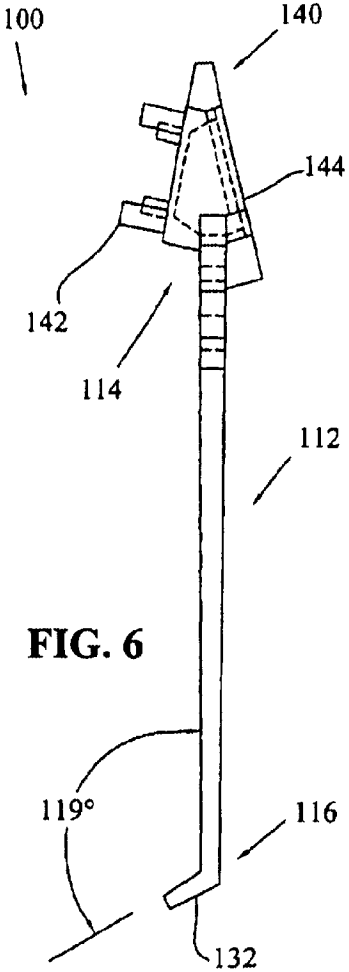
FIG. 6 is a side elevational view of another embodiment of a drum and faucet wrench according to the present invention.

Turning now to FIG. 6, another embodiment of a drum plug and faucet wrench is generally shown at 100. In this embodiment, the wrench 100 includes an elongated body 112 having one end 116 that has a plug drive element 132 directly attached. At the opposite end 114 of the body 112, a plug tool head 140 is attached. Plug tool head 140 can include a pair of drive elements 142 and 144 shown most clearly in FIGS. 7 and 8, respectively. Tool head 140 can also include an additional drive element 146 which is also shown most clearly in FIGS. 7 and 8 projecting laterally from the tool head 140. Preferably all of the drive elements 142, 144, and 146 are of different configurations to provide a wrench that can be used on a variety of drum plugs.

Figure 8:
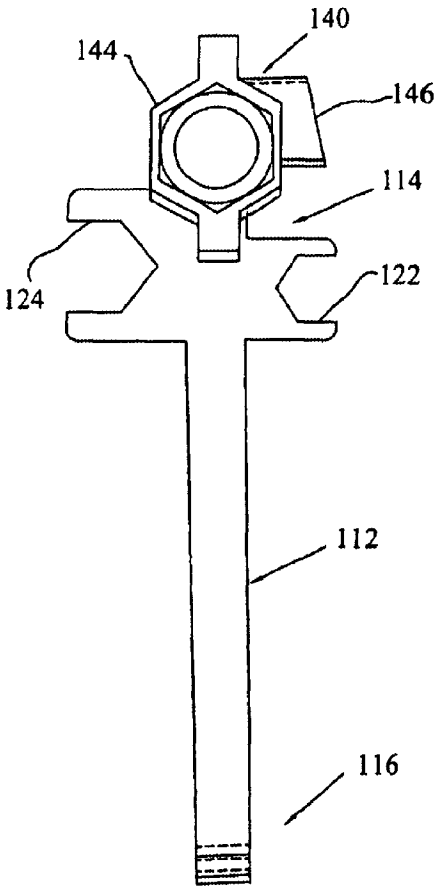
FIG. 8 is a rear elevational view of the wrench of FIG. 6 showing a second plug drive element and detail.
Figure 7:
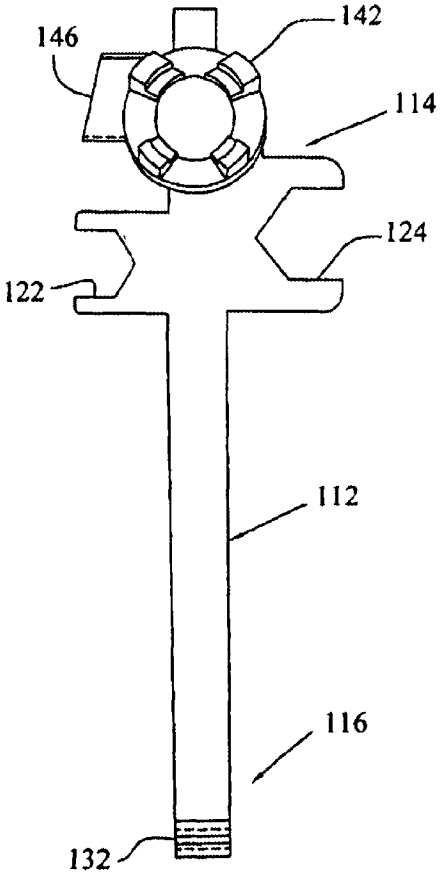
FIG. 7 is a front elevational view of the wrench of FIG. 6 showing one plug drive element in detail.

With reference still to FIGS. 7 and 8, there is also shown flanges 120 and 120' extending in opposite lateral directions from the wrench body 112. Open end wrench heads 122 and 124 can be formed in flanges 120' and 120, respectively. As with the embodiment of FIG. 1, open end wrench heads 122 and 124 are preferably of different sizes. Wrench head 122 can be sized at about 15/16 inches for working with ring bolts while wrench head 124 can be sized at about 1¼ inches for working with faucets. Of course, other sizes may also be used to suit the particular task for a given work environment.

Due to the nature of the intended uses, the wrenches contemplated in this invention would preferably be made of steel or similar materials.

A drum plug and faucet wrench according to the present invention overcomes the shortcomings of the prior art by providing a single tool that can be used on a variety of drum plugs, drum faucets and ring bolts.

While the invention has been illustrated and described in detail in the drawings and foregoing description, the same is to be considered illustrative and not restrictive in character. It should be understood that only the preferred embodiments have been shown and described and that all changes and modifications that come within the spirit of the invention are desired to be protected.

What is claimed is:

1. A drum plug and faucet wrench comprising:

an elongated body having first and second opposite end portions with a bend located intermediate, each said end portion including at least one plug tool head attached and integral thereto; and at least one integral flange projecting from said body, said at least one flange including a plurality of open end wrench heads, each of said wrench heads being different in size from the other of said wrench heads and at least one of said plurality of open end wrenches is sized for turning a faucet and at least one other of said plurality of open end wrenches is sized for turning a drum ring bolt;

wherein said bend is at an angle of about 140 degrees and each of said tool heads is attached to a respective end portion of said body at an angle of about 100 degrees relative to said end portion.

2. The wrench of claim 1, wherein said elongated body includes a central portion including said bend located in a plane, each said tool head having a pair of plug drive elements, each of said drive elements being different from the other of said drive elements.

3. The wrench of claim 2, wherein said angle of attachment of each of said tool heads is in said bend plane.

4. The wrench of claim 1, wherein said first end includes a drum plug tool head, and said second end defines a first drive element.

5. The wrench of claim 4, wherein said drum plug tool head includes second and third drive elements.

6. The wrench of claim 5, wherein said first drive element is different from said second drive element and said third drive element is different from said first and second drive elements.

7. The wrench of claim 5, wherein said plug tool head includes a fourth drive element different from said first, second, and third drive elements.

8. The wrench of claim 4, wherein said at least one flange includes a pair flanges disposed on opposite sides of said body, each said flange including an open end wrench head.

9. The wrench of claim 8, wherein one of said open end wrenches is sized for turning a faucet and the other is sized for turning a drum ring bolt.

10. The wrench of claim 4, wherein said first drive element is at an angle of about 119 degrees relative to said body.

* * * * *